US007946108B2

(12) United States Patent
Franz et al.

(10) Patent No.: US 7,946,108 B2
(45) Date of Patent: May 24, 2011

(54) METHOD FOR REGENERATING A NITROGEN OXIDE STORAGE CATALYTIC CONVERTER

(75) Inventors: Jens Franz, Stuttgart (DE); Uwe Hofmann, Reichelsheim (DE)

(73) Assignee: Daimler AG, Stuttgart (DE)

( * ) Notice: Subject to any disclaimer, the term of this patent is extended or adjusted under 35 U.S.C. 154(b) by 1027 days.

(21) Appl. No.: 10/584,237

(22) PCT Filed: Dec. 1, 2004

(86) PCT No.: PCT/EP2004/013604

§ 371 (c)(1),
(2), (4) Date: Apr. 12, 2007

(87) PCT Pub. No.: WO2005/066468

PCT Pub. Date: Jul. 21, 2005

(65) Prior Publication Data

US 2007/0234710 A1 Oct. 11, 2007

(30) Foreign Application Priority Data

Dec. 24, 2003 (DE) ..... 103 61 286

(51) Int. Cl.
*F01N 3/00* (2006.01)

(52) U.S. Cl. ..... 60/286; 60/274; 60/285

(58) Field of Classification Search ..... 60/274, 60/285, 286
See application file for complete search history.

(56) References Cited

FOREIGN PATENT DOCUMENTS

| | | | | |
|---|---|---|---|---|
| DE | 199 15 793 | A1 | | 4/1999 |
| DE | 19915793 | A1 | * | 10/2000 |
| DE | 101 13 947 | B4 | | 3/2001 |
| EP | 1 209 332 | A2 | | 11/2001 |
| EP | 1209332 | A2 | * | 5/2002 |
| GB | 2375059 | B | * | 1/2004 |

* cited by examiner

*Primary Examiner* — Thomas E Denion
*Assistant Examiner* — Jason Shanske
(74) *Attorney, Agent, or Firm* — Crowell & Moring LLP

(57) ABSTRACT

In a method for regenerating a nitrogen oxide storage catalytic converter arranged in an exhaust pipe of an internal combustion engine, a constant value is set in a first regeneration phase for the air/fuel ratio $\lambda_M$ of the air/fuel mixture fed to the internal combustion engine when a predeterminable triggering threshold value for the nitrogen oxide concentration in the exhaust gas on the output side of the nitrogen oxide storage catalytic converter is exceeded. The first regeneration phase is followed by a second regeneration phase, in which the time rate of change $d\lambda_M/dt$ of the air/fuel ratio $\lambda_M$ is set as a function of the mass flow of the exhaust gas flowing through the nitrogen oxide storage catalytic converter or as a function of an internal combustion engine operating variable linked with the mass flow of exhaust gas.

7 Claims, 2 Drawing Sheets

METHOD FOR REGENERATING A NITROGEN OXIDE STORAGE CATALYTIC CONVERTER

BACKGROUND AND SUMMARY OF THE INVENTION

This application claims the priority of German patent document 103 61 286.6, filed Dec. 24, 2003 (PCT International Application No. PCT/EP2004/013604, filed Dec. 1, 2004), the disclosure of which is expressly incorporated by reference herein.

The invention relates to a method for regenerating a nitrogen oxide storage catalytic converter arranged in an exhaust pipe of an internal combustion engine.

German patent document DE 101 13 947 A1 discloses a method for regenerating a nitrogen oxide storage catalytic converter of the generic type. Nitrogen oxide storage catalytic converters are used in particular in motor vehicles which have an internal combustion engine which can be operated with an air/fuel mixture alternating between clean and rich conditions. During operation with a lean air/fuel mixture, the barium carbonate which is present, for example, in the catalyst material of the nitrogen oxide storage catalytic converter removes nitrogen oxide (NOx) from the exhaust gas, which is at that time oxidizing, to form solid barium nitrate. On account of the associated load imposed on the material, from time to time it is necessary to regenerate the NOx storage catalytic converter. This process, which is known as nitrate regeneration, is effected by operating the internal combustion engine with a rich air/fuel mixture for a certain time. In the process, the barium nitrate, which is unstable in the resulting exhaust gas containing reducing agent, decomposes again to form barium carbonate and to release NOx. The latter is then reduced by the reducing agents ($H_2$, CO and HC) present in the exhaust gas, at the precious metal component which is applied to the NOx storage catalytic converter, predominantly to form harmless nitrogen ($N_2$).

In German patent document DE 101 13 947 A1, the regeneration of a nitrogen oxide storage catalytic converter is initiated when a predetermined threshold value for the nitrogen oxide concentration in the exhaust gas on the output side of the nitrogen oxide storage catalytic converter is exceeded. In this case, the regeneration comprises a first phase, in which the air/fuel mixture fed to the internal combustion engine is comparatively greatly enriched, and a second regeneration phase following the first regeneration phase, in which the air/fuel mixture fed to the internal combustion engine is comparatively less enriched.

Accordingly, lowering the levels of NOx over a prolonged period using the above method requires alternating the operation of the internal combustion engine between lean and rich conditions. It should be noted, however, that the rich-burn operation required for the nitrate regeneration operations diminishes the benefit that is achieved in terms of fuel consumption by lean burn operation of the internal combustion engine. Therefore, with a view to fuel consumption, it is desirable for the proportion of time taken up by lean-burn operation to be as high as possible, and therefore that the regeneration to be as short as possible. On the other hand, it is desirable for the regeneration of the nitrogen oxide storage catalytic converter to be as complete as possible so that, after regeneration has taken place, the storage catalytic converter is capable of storing as much nitrogen oxide as possible. Nevertheless, for emission reasons, a breaking through of harmful reducing agents should be avoided.

Therefore one object of the invention is to provide a method for regenerating a nitrogen oxide storage catalytic converter as efficiently and effectively as possible.

This and other objects and advantages are achieved by the method according to the invention, in which a regeneration is triggered when a triggering threshold value for the nitrogen oxide concentration in the exhaust gas on the output side of the nitrogen oxide storage catalytic converter is exceeded. Initially, a first regeneration mode with a constant air/fuel ratio $\lambda_M$ of the air/fuel mixture burned in the internal combustion engine is set. Following the first regeneration mode, according to the invention a second regeneration mode with a variable value for the air/fuel ratio $\lambda_M$ is set. In the second regeneration mode, the time rate of change $d\lambda_M/dt$ of the air/fuel ratio $\lambda_M$ is set as a function of either the mass flow of the exhaust gas flowing through the nitrogen oxide storage catalytic converter, or an internal combustion engine operating variable linked with the mass flow of exhaust gas.

The air/fuel ratio, also referred to as the lambda value, is understood here, in the usual way, as meaning the stoichiometry ratio of the content of oxygen and the content of fuel or of reducing components in the air/fuel mixture fed to the internal combustion engine or in the exhaust gas. The designation $\lambda_M$ is selected below for the air/fuel ratio of the air/fuel mixture fed to the internal combustion engine. In this case, during the regeneration of the air/fuel mixture fed to the internal combustion engine, a lambda value of $\lambda_M \leqq 1.0$, (that is, a stoichiometric or reducing air/fuel mixture) is preferably set.

The manner in which the time rate of change $d\lambda_M/dt$ of the air/fuel ratio $\lambda_M$ depends on the mass flow of the exhaust gas flowing through the nitrogen oxide storage catalytic converter or on an internal combustion engine operating variable linked with the mass flow of exhaust gas, is preferably selected in such a manner that given a comparatively small mass flow of exhaust gas, the nitrogen oxide storage catalytic converter in the second regeneration mode is fed, with an exhaust gas having a temporally rising content of reducing agent and, given a higher mass flow of exhaust gas, it is fed with an exhaust gas having a temporally decreasing content of reducing agent. In addition, the dependency is preferably selected in such a manner that, at customary driving states of the associated motor vehicle, a gradually rising lambda value is produced over the course of the second regeneration phase.

In this manner, it is taken into account that, as the regeneration continues, the demand for reducing agent gradually decreases. An excess of reducing agent supplied and a resulting leakage of reducing agent are therefore also avoided. Since a decreasing lambda value is set when there is a small mass flow of exhaust gas, the length of time that the reducing agent spends in the volume of the catalytic converter increases when there is a small mass flow of exhaust gas, and the reducing agent can therefore be completely converted even at high concentration, thus avoiding leakage of the reducing agent.

In a refinement of the invention, the first regeneration mode is ended after a predeterminable first period of time. In the first regeneration mode, a comparatively low air/fuel ratio of approximately $\lambda_M = 0.8$ is set. The period of time for maintaining the first regeneration mode (first regeneration phase) is also dependent on the volume of the nitrogen oxide storage catalytic converter and is preferably selected to be comparatively short (for example, approximately one second). The period of time and the lambda value of the first phase of the regeneration of the nitrogen oxide storage catalytic converter, if the latter still has a comparatively large amount of nitrogen oxides or oxygen stored in it, is preferably selected such that a large part of the stored nitrogen oxides or of the stored oxygen is already reduced, thus avoiding leakage of reducing agent. The selection of predeterminable and preferably fixedly applied values for the duration and the air/fuel ratio in the first regeneration phase takes account of the fact that, after the lean-burn storage phase ends, a minimal amount of nitrogen oxides is stored in the nitrogen oxide storage catalytic converter.

In a further refinement of the invention, the second regeneration mode is ended after a predeterminable second period of time. The second period of time is preferably fixedly applied and selected in such a manner that, taking the storage capacity of the nitrogen oxide storage catalytic converter into account, the majority of the stored nitrogen oxides is reduced when this regeneration phase ends.

In a further refinement of the invention, in a third regeneration mode, the time rate of change $d\lambda_M/dt$ of the air/fuel ratio $\lambda_M$ is set as a function of the mass flow of exhaust gas or as a function of both an internal combustion engine operating variable linked with the mass flow of exhaust gas and the measured value of a lambda probe arranged in the exhaust pipe on the output side of the nitrogen oxide storage catalytic converter. In this case, a lambda probe is understood as meaning a sensor which supplies a signal dependent on the lambda value of the exhaust gas. An NOx sensor, preferably with lambda functionality, can likewise be used. By additionally taking into consideration the lambda value of the exhaust gas present on the output side of the nitrogen oxide storage catalytic converter, the regeneration progress can be particularly reliably detected and taken into consideration by the consequent setting of the air/fuel ratio of the internal combustion engine. An oversupply of the nitrogen oxide storage catalytic converter with reducing agents and an associated leakage of reducing agent can therefore be avoided. This is particularly important toward the end of the regeneration when only small amounts of nitrogen oxide are still stored in the nitrogen oxide storage catalytic converter.

The third regeneration mode may be set instead of the second regeneration mode, but, according to a further refinement of the invention, the third regeneration mode is preferably set directly after the second regeneration mode ends.

In a further refinement of the invention, the setting of the air/fuel ratio $\lambda_M$ is limited to a value range with a predeterminable lower limit value $\lambda_{min}$ and a predeterminable upper limit value $\lambda_{max}$. This measure firstly makes it possible to avoid too sharp a drop of the air/fuel ratio and therefore a leakage of reducing agent. Secondly, it is avoided that the air/fuel ratio rises too severely and thereby, under some circumstances, the rich range preferred for the regeneration is even exceeded and hence regeneration no longer takes place. Preferably, when the lower limit value $\lambda_{min}$ is reached, the air/fuel ratio is kept at the lower limit value until a rise of the air/fuel ratio is initiated again by the mass flow of exhaust gas rising. Correspondingly, it is preferably provided, when the upper limit value $\lambda_{max}$ for the air/fuel ratio is reached, to keep the latter at this limit value until a dropping of the air/fuel ratio is initiated again by the mass flow of exhaust gas dropping.

In a further refinement of the invention, the triggering threshold value for triggering the regeneration of the nitrogen oxide storage catalytic converter is predetermined and/or the time rate of change $d\lambda_M/dt$ of the air/fuel ratio $\lambda_M$ is set as a function of an aging factor representing the aging of the nitrogen oxide storage catalytic converter. The aging factor representing the aging is preferably derived from the current nitrogen oxide storage capacity of the nitrogen oxide storage catalytic converter and comparison with the nitrogen oxide storage capacity of the nitrogen oxide storage catalytic converter in the unaged state. The current nitrogen oxide storage capacity can be determined, for example, by measuring leakage of nitrogen oxide during the lean storage phase and comparing it with the raw emission of nitrogen oxide from the internal combustion engine. In this case, it is advantageous to determine the storage capacity of the nitrogen oxide storage catalytic converter with predeterminable reference conditions, for example with regard to speed of rotation, load and/or exhaust gas temperature, and to compare it with a reference value, determined beforehand under the same conditions, of the unaged nitrogen oxide storage catalytic converter.

By matching the triggering threshold value to the aging state of the nitrogen oxide storage catalytic converter, aging-induced reduction of the nitrogen oxide storage capacity can be reacted to. Preferably, as the nitrogen oxide storage catalytic converter increases in age, the triggering threshold value is lowered. The regeneration operations therefore take place at shorter intervals with which the lower storage capacity is taken into account. By means of the aging-dependent setting of the time rate of change $d\lambda_M/dt$ of the air/fuel ratio $\lambda_M$ in the second or in the third regeneration phase, the aging-induced reduced amount of stored nitrogen oxides can be reacted to and the regeneration correspondingly adapted. Preferably, as the nitrogen oxide storage catalytic converter increases in age, a greater change of the air/fuel ratio $\lambda_M$ can be provided at a certain mass flow of exhaust gas, so that the duration of the regeneration is shortened.

Other objects, advantages and novel features of the present invention will become apparent from the following detailed description of the invention when considered in conjunction with the accompanying drawings.

DETAILED DESCRIPTION OF THE DRAWINGS

Figure 1:
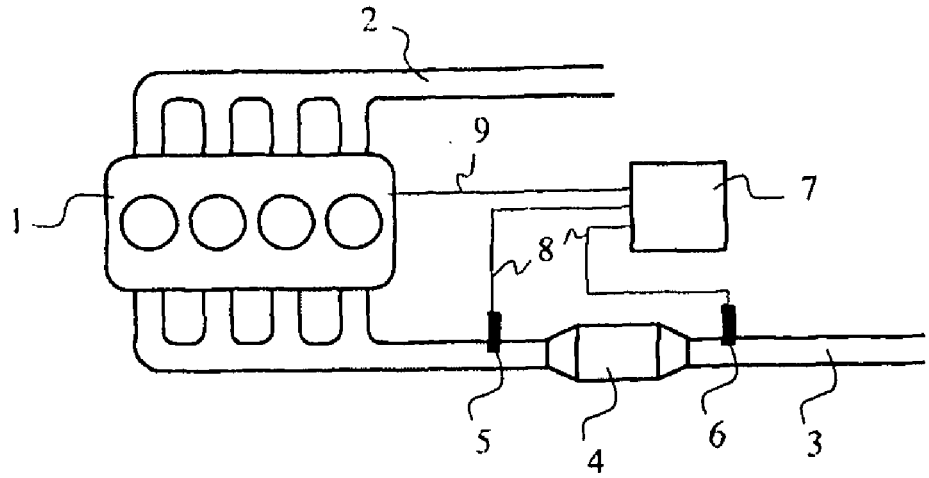
FIG. 1 is a diagrammatic illustration of an internal combustion engine with an exhaust pipe in which a nitrogen oxide storage catalytic converter is arranged.

FIG. 1 is a basic diagrammatic illustration which shows an internal combustion engine 1 with an intake air line 2, an exhaust pipe 3 with a nitrogen oxide storage catalytic converter 4 arranged in it, and an electronic engine control unit 7. The internal combustion engine 1 may be, for example, a four-cylinder spark-ignition engine capable of running in lean-burn mode. In the exhaust pipe, a first exhaust gas measuring probe 5 and a second exhaust gas measuring probe 6 are arranged upstream and downstream of the nitrogen oxide storage catalytic converter 4 and their signal lines 8 lead to the engine control unit 7. The engine control unit 7 is furthermore connected by a signal line 9 to the engine 1 in order to set and detect the operating parameters of the engine. Further devices for controlling the operation of the engine, such as injection valves, fuel supply, exhaust gas recirculation, inlet air regulation and the like are not illustrated for clarity reasons. Connections of the control unit 7 to sensors for detecting further operating variables, such as rotational speed of the engine, current driving speed of the associated motor vehicle, selected driving position of the transmission and the like are not illustrated either. It goes without saying, however, that the control unit 7 has the customary possibilities for detecting and, if appropriate, influencing the operating state of the engine 1 and of the associated motor vehicle. Furthermore, further exhaust gas cleaning components (not illustrated here), such as, for example, a starting catalytic converter which is preferably arranged upstream of the nitrogen oxide storage catalytic converter 4 and is designed as an oxidation catalytic converter, may, of course, be present.

The exhaust gas measuring probes 5, 6 are preferably designed as "lambda probes" for detecting the air/fuel ratio of the exhaust gas, called exhaust gas lambda $\lambda_A$ below, at the corresponding point in the exhaust pipe 3. An embodiment of the second exhaust gas measuring probe 6 as a combined NOx/lambda probe with which both the nitrogen oxide content in the exhaust gas and the air/fuel ratio thereof can be determined, is particularly preferred. It is likewise advantageous to design the second exhaust gas measuring probe as a "binary lambda probe" with a very steep characteristic-curve profile in a narrow range about an air/fuel ratio of $\lambda=1.0$. The first exhaust gas measuring probe 5 is preferably used to regulate the air/fuel ratio $\lambda_M$ of the air/fuel mixture fed to the engine. It is advantageous here to arrange the first exhaust gas measuring probe upstream, seen in the direction of flow, of the first exhaust gas catalytic converter provided in the exhaust pipe 3.

Figure 2:
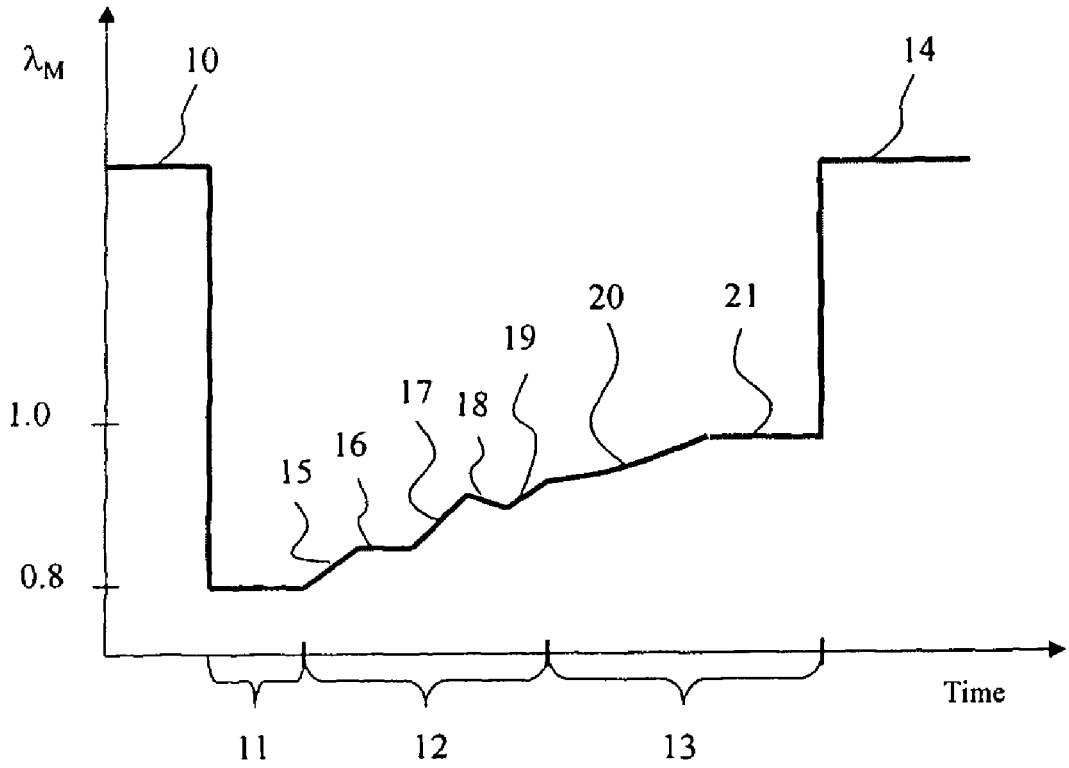
FIG. 2 is a graphic which shows a typical time variation of the regeneration of the nitrogen oxide storage catalytic converter.

Advantageous embodiments for regenerating the nitrogen oxide storage catalytic converter 4 are explained below, with measurement signals of the exhaust gas measuring probes 5, 6 being returned to. For explanation, use is made of the diagram which is illustrated in FIG. 2 and in which a typical profile of the air/fuel ratio $\lambda_M$ is sketched. The corresponding values can be supplied by the lambda probe 5 as measured values.

Starting from a lean storage phase 10, a switch is made into the regeneration mode which comprises three consecutive regeneration phases 11, 12, 13 in which three different regeneration modes are set. When the third regeneration phase 13 ends, a switch is made back again into a further lean storage phase 14.

The regeneration of the nitrogen oxide storage catalytic converter 4 is preferably triggered by the engine control unit 7 when a threshold value for the nitrogen oxide concentration detected on the output side of the nitrogen oxide storage catalytic converter by the exhaust gas measuring probe 6 is reached. The nitrogen oxide concentration can also be evaluated with the current mass flow of exhaust gas $m_{Exhaust\ gas}$, so that the mass flow of nitrogen oxide on the output side of the nitrogen oxide storage catalytic converter 4 is obtained, and, when a corresponding threshold value for the mass flow of nitrogen oxide is reached, the regeneration is triggered. It is likewise advantageous to integrate the mass flow of nitrogen oxide during the lean storage phase 10, as a result of which an integral value for the leakage of nitrogen oxide during the lean storage phase is obtained. In this case, the regeneration is triggered when a threshold value for the integral leakage of nitrogen oxide is reached. A typical profile of the regeneration is explained below.

After the regeneration has been triggered, for a first regeneration phase 11 first of all a first regeneration mode with a comparatively rich air/fuel ratio of approximately $\lambda_M=0.8$ is preferably set suddenly and is maintained for a predeterminable first period of time. This first period of time is preferably programmed into the engine control unit 7 and is approximately one second. However, it can also be provided to adapt the first period of time adaptively to the storage capacity or to the aging of the nitrogen oxide storage catalytic converter 4 and, if appropriate, to change, preferably to shorten it. This is discussed in more detail further below.

After the first period of time for the first regeneration phase 11 has elapsed, the second regeneration phase 12 is transferred to and, in a second regeneration mode, the air/fuel ratio $\lambda_M$ is changed as a function of the mass flow of exhaust gas $m_{Exhaust\ gas}$. For this purpose, the time rate of change $d\lambda_M/dt$ of the air/fuel ratio $\lambda_M$ is set as a function of the mass flow $m_{Exhaust\ gas}$ of the exhaust gas flowing through the nitrogen oxide storage catalytic converter 4. However, instead of the mass flow of exhaust gas $m_{Exhaust\ gas}$, use may also be made of an internal combustion engine operating variable linked with the mass flow of exhaust gas $m_{Exhaust\ gas}$, such as, for example, the rotational speed of the engine and/or the engine load.

The time rate of change $d\lambda_M/dt$ of the air/fuel ratio $\lambda_M$ is preferably set as a function of the mass flow of exhaust gas $m_{Exhaust\ gas}$ in accordance with a characteristic diagram stored in the engine control unit 7. However, a functional dependency stored in the engine control unit 7 may also be used for setting the time rate of change $d\lambda_M/dt$ of the air/fuel ratio $\lambda_M$. For example, a linear dependency is illustrated in diagram form in FIG. 3.

The continuing sequence of the regeneration of the nitrogen oxide storage catalytic converter 4 is explained below with reference to FIGS. 1 to 3. The dependence of the time rate of change $d\lambda_M/dt$ on the air/fuel ratio $\lambda_M$ with $d\lambda_M/dt=f(m_{Exhaust\ gas})$ is described here. It goes without saying that a functional dependency for the change $d\lambda_M/dt$ of the air/fuel ratio AM on the mass flow of exhaust gas $m_{Exhaust\ gas}$ different from the linear dependency illustrated in the diagram of FIG. 3 may also be provided. For example, a stepped dependency is also advantageous. This can be stored in the engine control unit 7 in the form of a table of values or in the form of a characteristic diagram. In each case, a dependency $d\lambda_M/dt=f(m_{Exhaust\ gas})$ is provided with which, under customary engine operating states, a gradual rise of the air/fuel ratio $\lambda_M$ is produced.

Figure 3:
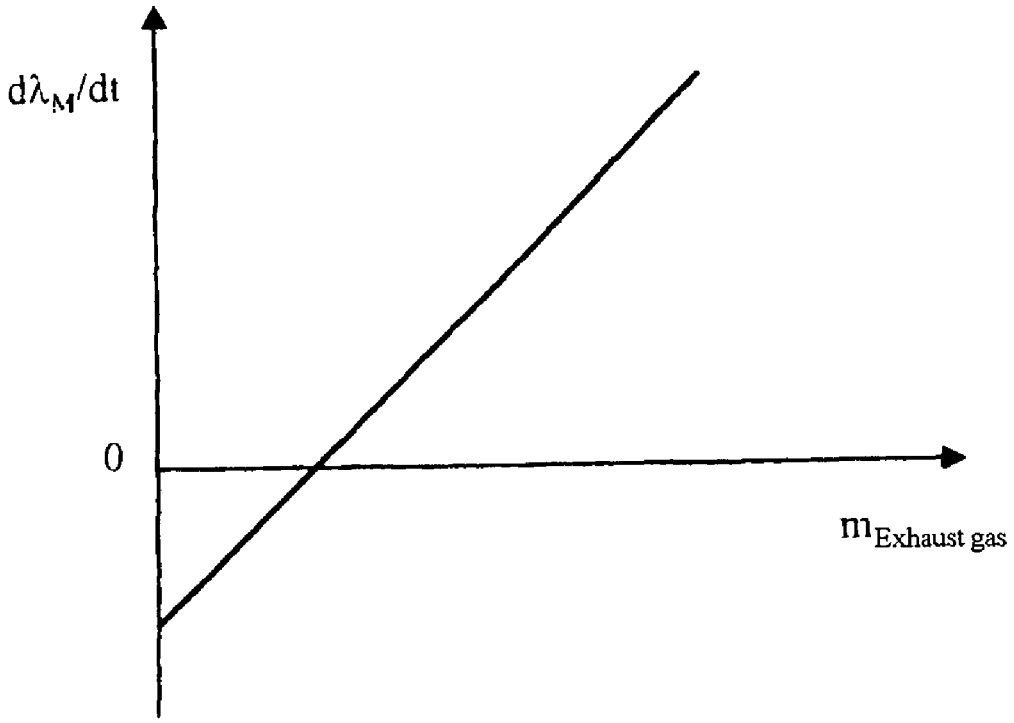
FIG. 3 is a diagram illustrating a relationship between air/fuel ratio change and time.

According to the relationship illustrated in FIG. 3, a value range exists for the mass flow of exhaust gas $m_{Exhaust\ gas}$ to which negative values for the change $d\lambda_M/dt$ of the air/fuel ratio are assigned and therefore in which a dropping of the air/fuel ratio $\lambda_M$ is set. Similarly, there is a value range for the mass flow of exhaust gas $m_{Exhaust\ gas}$ to which positive values for $d\lambda_M/dt$ are assigned and therefore in which a rising of the air/fuel ratio $\lambda_M$ is set. According to the example of the air/fuel ratio profile illustrated in FIG. 2, in the time sections 15, 17, 19 there is a mass flow of exhaust gas $m_{Exhaust\ gas}$ in which the air/fuel ratio $\lambda_M$ rises in accordance with the dependency illustrated in FIG. 3. By contrast, in the time section 18 there is a mass flow of exhaust gas $m_{Exhaust\ gas}$ in which the air/fuel ratio $\lambda_M$ drops in accordance with the dependency illustrated in FIG. 3. Correspondingly, in the time section 16 there is a mass flow of exhaust gas $m_{Exhaust\ gas}$ in which a constant air/fuel ratio $\lambda_M$ is set in accordance with the dependency illustrated in FIG. 3. Preferably, however, a rising or a dropping of the air/fuel ratio $\lambda_M$ is set only if a predeterminable upper limit value $\lambda_{max}$ of, for example, $\lambda_{max}=0.95$ or a lower limit value $\lambda_{min}$ of, for example, $\lambda_{min}=0.8$ for the air/fuel ratio $\lambda_M$ is not reached.

Figure 4:
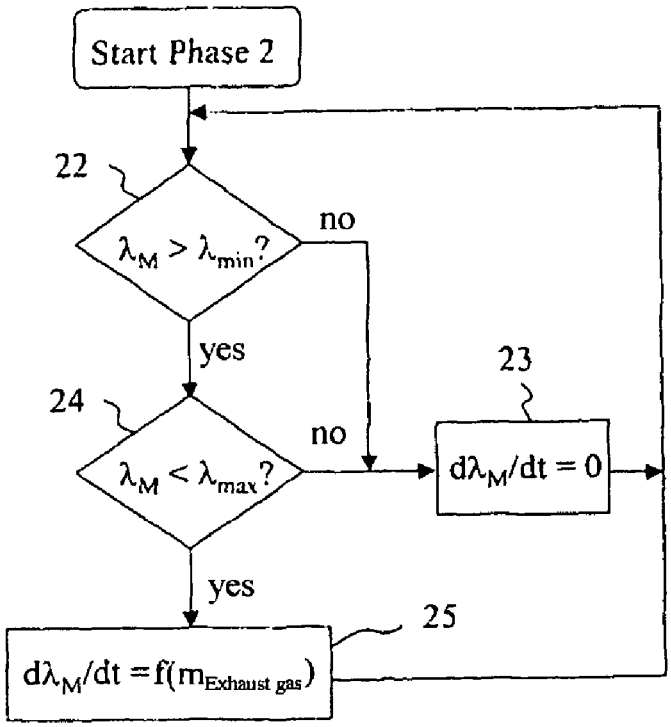
FIG. 4 is a sequence diagram illustrating how an increased or decreased air/fuel ratio is set.

The corresponding procedure is clarified in the sequence diagram illustrated in FIG. 4. Accordingly, after entering the second regeneration phase 12, it is asked in the interrogation block 22 whether the air/fuel ratio $\lambda_M$ is greater than a predeterminable lower limit value $\lambda_{min}$. If not, then a constant air/fuel ratio $\lambda_M$ is set by the function block 23. If the air/fuel ratio $\lambda_M$ is greater than a predeterminable lower limit value $\lambda_{min}$, then the interrogation block 24 is continued to and it is asked whether the air/fuel ratio $\lambda_M$ is lower than a predeterminable upper limit value $\lambda_{max}$. If not, then a constant air/fuel ratio $\lambda_M$ is set by the function block 23, otherwise, with the function block 25, a change $d\lambda_M/dt$ of the air/fuel ratio is undertaken in accordance with a preprogrammed, functional dependence $d\lambda_M/dt=f(m_{Exhaust\ gas})$ on the mass flow of exhaust gas $m_{Exhaust\ gas}$, for example in accordance with the dependency illustrated in the diagram of FIG. 3.

The second regeneration phase 12 is preferably ended after a second period of time programmed into the engine control unit and the continuous running of the sequence diagram according to FIG. 4 is terminated. However, it may also be provided to match the second period of time adaptively to the storage capacity or to the aging of the nitrogen oxide storage catalytic converter and, if appropriate, to change, preferably to shorten it.

After the second period of time for the second regeneration phase 12 expires, the third regeneration phase 13 is commenced. In the latter, in a third regeneration mode for setting the air/fuel ratio $\lambda_M$, in addition to the mass flow of exhaust gas $m_{Exhaust\ gas}$ the air/fuel ratio $\lambda_A$ of the exhaust gas detected on the output side of the nitrogen oxide storage catalytic converter 4 or the output signal, which is related thereto, of the second exhaust gas measuring probe 6 is taken into consideration. For this purpose, it can be provided to derive from the detected air/fuel ratio $\lambda_A$ a first correction factor $k_1$ which, for example, is proportional thereto and with which the value determined as described above for the change $d\lambda_M/dt$ of the air/fuel ratio $\lambda_M$ is multiplied as a function of the dependency $d\lambda_M/dt=f(m_{Exhaust\ gas})$. In the case of a first correction factor $k_1$ which is proportional to the air/fuel ratio $\lambda_A$, it is advantageous to link the proportionality with the value of the air/fuel ratio $\lambda_A$ at the beginning of the third regeneration phase 13, as a result of which the progress of the regeneration can be evaluated. The method sequence in the third regeneration phase 13 therefore corresponds to the sequence diagram, illustrated in FIG. 4, for the second regeneration phase 12, with, in contrast to the method sequence of the second regeneration phase 12, in function block 25 the correspondingly changed entry $d\lambda_M/dt=k_1*f(m_{Exhaust\ gas})$ now having to be taken into consideration.

Since, as the regeneration progresses further, the air/fuel ratio $\lambda_A$ of the exhaust gas approaches the set air/fuel ratio $\lambda_M$ from above, in accordance with the regeneration section, which is provided with the reference number 20 in FIG. 2, the air/fuel ratio $\lambda_M$ is further "raised". If the upper limit value $\lambda_{max}$ is reached, then the air/fuel ratio $\lambda_M$ remains at this upper limit value unless a dropping of the air/fuel ratio $\lambda_M$ is caused by a very severe dropping of the mass flow of exhaust gas. This retention of the air/fuel ratio $\lambda_M$ corresponds to the regeneration section provided with the reference number 21 in FIG. 2.

The regeneration is ended and engine operation is transferred to a lean or stoichiometric air/fuel ratio $\lambda_M$ if the second exhaust gas measuring probe 6 on the output side of the nitrogen oxide storage catalytic converter 4 drops below a predeterminable lower threshold value for the air/fuel ratio $\lambda_A$ of the exhaust gas of, for example, $\lambda_A=0.98$, which would correspond to a breakthrough of reducing agent. In particular in the case of a second exhaust gas measuring probe 6 designed as a "binary probe", it is advantageous, on account of the steep characteristic curve profile around $\lambda=1.0$, to end the regeneration if the measurement signal of this probe exceeds a predeterminable upper limit value.

It is assumed here that the measurement signal of the second exhaust gas measuring probe 6, which is designed as a binary probe, behaves in an opposed manner to the value of the air/fuel ratio $\lambda_A$. The ending of the regeneration may, however, also take place on the basis of a computer model stored in the engine control unit 7. In this case, the regeneration is ended if the amount of reducing agent entered overall into the nitrogen oxide storage catalytic converter exceeds the amount of reducing agent necessary for reducing the amount of nitrogen oxide stored at the beginning of the regeneration. It is particularly advantageous to end the regeneration if one of the two mentioned criteria occurs. In this connection, it is advantageous to correct or to adapt the stored computer model for the balancing of the reducing agent with the aid of the measured value supplied by the exhaust gas measuring probe 6 with the effect of obtaining the best possible correspondence.

The explained procedure according to the invention for regenerating a nitrogen oxide storage catalytic converter 4 can be advantageously matched to an aging, which increases over the course of time, of the nitrogen oxide storage catalytic converter 4. Such aging may occur, for example, because of sulfuric poisoning, which increases over the course of time, due to the sulfur present in the fuel. In such poisoning, sulfur is embedded in the form of sulfates in the nitrogen oxide storage catalytic converter 4, which reduces its storage capacity for nitrogen oxides. However, an aging with a corresponding decrease in the nitrogen oxide storage capacity can also be caused by thermal overloading.

In order to detect and to evaluate the state of aging of the nitrogen oxide storage catalytic converter 4, it is therefore provided to determine its nitrogen oxide storage capacity continuously or from time to time. For this purpose, during the lean storage phase, the leakage of nitrogen oxide emerging from the nitrogen oxide storage catalytic converter 4 is determined, for example, by means of the exhaust gas measuring probe 6 and is compared with the entry of nitrogen oxide. The latter can be provided on the basis of a nitrogen oxide emission characteristic diagram of the engine 1 that has been placed in the engine control unit 7. According to the invention, it is provided to form an aging factor from the decrease, which is established in comparison to the state when new, of the nitrogen oxide storage capacity of the nitrogen oxide storage catalytic converter 4 and to use this aging factor to match the regeneration or the alternating operation of the engine 1 under lean-burn and rich-burn conditions to the aging state of the nitrogen oxide storage catalytic converter 4.

For this purpose, it is advantageous to reduce the threshold value, which is decisive for the triggering of the regeneration, for the nitrogen oxide concentration detected on the output side of the nitrogen oxide storage catalytic converter 4 or the threshold value for the integral leakage of nitrogen oxide in the lean storage phase, as a function of the aging factor. This can take place proportionally, in the simplest case, in accordance with a predetermined, suitable, functional dependence. Furthermore, it is advantageous to adapt the first period of time for the first regeneration phase 11 and/or the second period of time for the second regeneration phase 12 as a function of the aging factor. This can likewise take place in accordance with a predetermined, suitable, functional dependency. In the simplest case, the first and/or the second period of time are shortened proportionally to the aging factor.

According to the invention, it is furthermore provided to set the functional dependency $d\lambda_M/dt=f(m_{Exhaust\ gas})$ of the time rate of change $d\lambda_M/dt$ of the air/fuel ratio $\lambda_M$ in the second regeneration phase 12 and/or the functional dependency $d\lambda_M/dt=k_1*f(m_{Exhaust\ gas})$ in the third regeneration phase 13 as a function of the aging factor. For this purpose, it is advantageous, when carrying out the method for the second regeneration phase 12, which corresponds to the sequence diagram illustrated in FIG. 4, now to take the changed entry $d\lambda_M/dt=k_2*f(m_{Exhaust\ gas})$ into consideration in the function block 25, with the second correction factor $k_2$ corresponding to the aging factor of the nitrogen oxide storage catalytic converter 4 or being derived therefrom. Similarly, when analogously carrying out the method of the third regeneration phase 13, according to the sequence diagram illustrated in FIG. 4, the changed entry $d\lambda_M/dt=k_1*k_2*f(m_{Exhaust\ gas})$ is now taken into consideration in the function block 25.

Values for the aging factor or the second correction factor $k_2$ can be determined by preliminary tests with storage catalytic converters aged to differing extents and can be deposited in the engine control unit 7.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A method for regenerating a nitrogen oxide storage catalytic converter arranged in an exhaust pipe of an internal combustion engine, said method comprising:

in a first regeneration mode, setting a constant value for an air/fuel ratio $\lambda_M$ of an air/fuel mixture burned in the internal combustion engine when nitrogen oxide concentration in exhaust gas on an output side of the nitrogen oxide storage catalytic converter exceeds a predeterminable triggering threshold value, which triggers a regeneration of the nitrogen oxide storage catalytic converter; and after the first regeneration mode; implementing a second regeneration mode in which a variable value is provided for the air/fuel ratio $\lambda_M$ such that the time rate of change $d\lambda_M/dt$ of the air/fuel ratio $\lambda_M$ is set as a function of one of i) mass flow of the exhaust gas flowing through the nitrogen oxide storage catalytic converter, and ii) an internal combustion engine operating variable linked with the mass flow of the exhaust gas;

wherein rising values of the air/fuel ratio $\lambda_M$ are assigned to a higher exhaust gas mass flow than dropping values of the air/fuel ratio $\lambda_M$.

2. The method as claimed in claim 1, wherein the first regeneration mode is ended after a predeterminable first period of time.

3. The method as claimed in claim 1, wherein the second regeneration mode is ended after a predeterminable second period of time.

4. The method as claimed in claim 1, further comprising:

in a third regeneration mode, setting the time rate of change $d\lambda_M/dt$ of the air/fuel ratio $\lambda_M$ as a function of one of i) the mass flow of exhaust gas, and ii) an internal combustion engine operating variable linked with the mass flow of exhaust gas, and also as a function of a measured value from a lambda probe arranged in the exhaust pipe on the output side of the nitrogen oxide storage catalytic converter.

5. The method as claimed in claim 4, wherein the third regeneration mode is set directly after the second regeneration mode ends.

6. The method as claimed in claim 1, wherein setting of the air/fuel ratio $\lambda_M$ is limited to a value range with a predeterminable lower limit value $\lambda_{min}$ and a predeterminable upper limit value $\lambda_{max}$.

7. The method as claimed in claim 1, wherein the triggering threshold value for triggering the regeneration of the nitrogen oxide storage catalytic converter is predetermined and/or the time rate of change $d\lambda_M/dt$ of the air/fuel ratio $\lambda_M$ is set as a function of an aging factor representing the aging of the nitrogen oxide storage catalytic converter.

* * * * *